US008222198B2

(12) United States Patent
Winter

(10) Patent No.: US 8,222,198 B2
(45) Date of Patent: Jul. 17, 2012

(54) PERFUMING NITRILES

(75) Inventor: Beat Winter, Bernex (CH); Lea Winter, legal representative, Bernex (CH); Alexandre Winter, legal representative, Geneva (CH)

(73) Assignee: Firmenich SA, Geneva (CH)

( * ) Notice: Subject to any disclaimer, the term of this patent is extended or adjusted under 35 U.S.C. 154(b) by 66 days.

(21) Appl. No.: 12/530,774

(22) PCT Filed: Mar. 27, 2008

(86) PCT No.: PCT/IB2008/051152

§ 371 (c)(1), (2), (4) Date: Jun. 29, 2010

(87) PCT Pub. No.: WO2008/117254

PCT Pub. Date: Oct. 2, 2008

(65) Prior Publication Data

US 2010/0267607 A1 Oct. 21, 2010

(30) Foreign Application Priority Data

Mar. 28, 2007 (WO) ..... PCT/IB2007/051085

(51) Int. Cl.
*A61Q 13/00* (2006.01)

(52) U.S. Cl. ..... 512/6

(58) Field of Classification Search ..... 512/6
See application file for complete search history.

(56) References Cited

U.S. PATENT DOCUMENTS

| | | | | |
|---|---|---|---|---|
| 3,168,550 | A * | 2/1965 | Blumenthal | 558/430 |
| 4,146,507 | A | 3/1979 | DeSimone | 252/522 |
| 4,156,690 | A | 5/1979 | DeSimone | 260/464 |
| 2003/0024997 | A1 * | 2/2003 | Welch et al. | 239/53 |

FOREIGN PATENT DOCUMENTS

| | | |
|---|---|---|
| DE | 1 293 156 | 4/1969 |
| DE | 26 56 065 | 6/1977 |
| GB | 1 367 060 | 9/1974 |

OTHER PUBLICATIONS

International Search Report, PCT/IB2008/051152, mailed Aug. 5, 2008.

"2,2-Dimethyl-3-(2,6,6-Trimethyl-2-Cyclohexen-1-YL)-Propionitrile," S. Arctander, Perfume and Flavor Chemicals, Montclair, New Jersey, No. 1064 (1969).

Brud et al., "Organic Nitriles in Perfumery," 6th International Congress of Essential Oils, 73 (1974).

Kato et al., "Cyclization of Polyenes. XII. Direct Brominative Ring Closure of Polyenes," Bioorganic Chemistry, 4:188-193 (1975).

Mateos et al., "πParticipation in Nucleophilic Displacement of α-Cyclogeranyl Tosylate," Tetrahedron Letters, 36(4):621-624 (1995).

Mateos et al., "Limonoid Model Insect Antifeedants. A Stereoselective Synthesis of Azadiradione C, D, and E Fragments through Intramolecular Diazo Ketone Cyclization," Journal of Organic Chemistry, 60:3580-3585 (1995).

Murai et al., "Cationic Cyclization of Geranonitrile and Related Compounds via their Bromohydrins: Application to the Synthesis of (±)-Snyderols," Chemistry Letters, 1125-1128 (1981).

* cited by examiner

*Primary Examiner* — Kuo-Liang Peng
(74) *Attorney, Agent, or Firm* — Winston & Strawn LLP

(57) ABSTRACT

The present invention relates to methods of using certain unsaturated derivatives of 2,6,6-trimethyl-cyclohexane-1-acetonitrile as perfuming ingredients. These compounds are valuable patchouli odorants.

9 Claims, No Drawings

PERFUMING NITRILES

This application is a 371 filing of International Patent Application PCT/IB2008/051152 filed Mar. 27, 2008.

TECHNICAL FIELD

The present invention relates to the field of perfumery. More particularly, it concerns the use as perfuming ingredients of unsaturated derivatives of cyclohexane-1-acetonitrile. The present invention concerns also the compositions or articles containing said compounds.

PRIOR ART

Amongst the compounds of formula (I), 2,6,6-trimethyl-1-cyclohexene-1-acetonitrile is known from the prior art. This compound has been reported by A. Murai et al. in *Chem. Lett.,* 1981, 1125, or by T. Kato et al. in *Biorganic Chemistry,* 1975, 188. The compound 2,6,6-trimethyl-2-cyclohexene-1-acetonitrile is also reported in the literature (see T. Kato et al., as well as A. F. Mateos et al., in *J. Org. Chem.,* 1995, 3580 or in *Tetrahedron Lett.,* 1995, 621).

However, these prior art documents report only their preparation and/or use as intermediates for the preparation of other compounds. These documents do not report or suggest any organoleptic properties of the compounds of formula (I), or any use of said compound in the field of perfumery.

The closest structural analogue described for a possible use in perfumery is 2,2-dimethyl-3-(2,6,6-trimethyl-2-cyclohexen-1-yl)-propionitrile (see W. S. Brud et al. in Int. Congr. Essent. Oils, $6^{th}$ (1974), 73, pg 61, as well as S. Arctander, Perfume and Flavor Chemicals, 1969, Montclair, N.J., USA, N° 1064). However, not only the structure, but also the organoleptic properties of this compound are quite different from the ones of the present invention. Thus, this prior art compound does not anticipate the present invention.

DESCRIPTION OF THE INVENTION

We have now surprisingly discovered that an unsaturated derivative of 2-cyclohexane-1-acetonitrile, of formula (I)

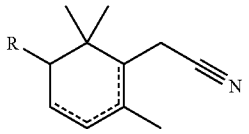

wherein R represents a hydrogen atom or a methyl group, one dotted line represents a carbon-carbon double bond and the other dotted lines represent a carbon-carbon single bond;

can be used as perfuming ingredient, for instance to impart odor notes of the patchouli type.

According to a particular embodiment of the invention, one may use the compounds wherein R represents a hydrogen atom.

According to another particular embodiment of the invention, one may use the compounds of formula (II)

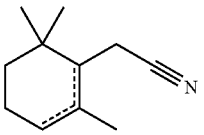

wherein one dotted line represents a carbon-carbon double bond and the other dotted line represents a carbon-carbon single bond.

In particular, one may also use 2,6,6-trimethyl-1-cyclohexene-1-acetonitrile.

The compound of formula (I) or (II) can be used in the form of any one of its optical isomers (e.g. (+)-2-cyclohexene-1-acetonitrile or (−)-2-cyclohexene-1-acetonitrile) or of a mixture thereof.

Furthermore, it is also possible to use mixtures of various compounds of formula (I) and/or (II) (e.g. mixtures of 2-cyclohexene-1-acetonitrile and of 1-cyclohexene-1-acetonitrile).

As specific, and non-limiting, example of invention's compounds, one may cite 2,6,6-trimethyl-1-cyclohexene-1-acetonitrile which displays an odor characterized by a very pleasant woody-patchouli character with somehow an earthy note. The odor develops on the bottom also a very nice damascone and tobacco aspect.

It is quite rare for a nitrile to display a strong woody-tobacco note which reminds immediately of the odor of patchouli. Furthermore, the presence of the damascone type aspect renders this compound even more interesting for the perfumers.

The quality and intensity of the patchouli character of this compound make it an interesting substitute of natural patchouli (which suffers from problems of availability on the market) in some applications.

Another example is 2,6,6-trimethyl-2-cyclohexene-1-acetonitrile.

When the odor of the invention's compounds is compared with the one of the prior art compound mentioned above, then the invention's compound distinguishes itself by possessing a patchouli note and a damascone-tobacco aspect, to the contrary of the prior art compound. Furthermore, the invention's compound lacks the sweet, pungent note so characteristic of the prior art compound.

As mentioned above, the invention concerns the use of a compound of formula (I) as perfuming ingredient. In other words it concerns a method to confer, enhance, improve or modify the odor properties of a perfuming composition or of a perfumed article, which method comprises adding to said composition or article an effective amount of at least a compound of formula (I). In particular the invention's compound can be used to impart odor notes of the patchouli type.

By "use of a compound of formula (I)" it has to be understood here also the use of any composition containing compound (I) and which can be advantageously employed in perfumery industry as active ingredients.

Said compositions, which in fact can be advantageously employed as perfuming ingredient, are also an object of the present invention.

Therefore, another object of the present invention is a perfuming composition comprising:

i) as perfuming ingredient, at least one invention's compound as defined above;

ii) at least one ingredient selected from the group consisting of a perfumery carrier and a perfumery base; and iii) optionally at least one perfumery adjuvant.

By "perfumery carrier" we mean here a material which is practically neutral from a perfumery point of view, i.e. that does not significantly alter the organoleptic properties of perfuming ingredients. Said carrier may be a liquid or a solid.

As liquid carrier one may cite, as non-limiting examples, an emulsifying system, i.e. a solvent and a surfactant system, or a solvent commonly used in perfumery. A detailed description of the nature and type of solvents commonly used in perfumery cannot be exhaustive. However, one can cite as non-limiting example solvents such as dipropyleneglycol, diethyl phthalate, isopropyl myristate, benzyl benzoate, 2-(2-ethoxyethoxy)-1-ethanol or ethyl citrate, which are the most commonly used.

As solid carrier one may cite, as non-limiting examples, absorbing gums or polymers, or yet encapsulating materials. Examples of such materials may comprise wall-forming and plasticizing materials, such as mono, di- or trisaccharides, natural or modified starches, hydrocolloids, cellulose derivatives, polyvinyl acetates, polyvinylalcohols, proteins or pectins, or yet the materials cited in reference texts such as H. Scherz, Hydrokolloids: Stabilisatoren, Dickungs- and Gehermittel in Lebensmittel, Band 2 der Schriftenreihe Lebensmittelchemie, Lebensmittelqualität, Behr's VerlagGmbH & Co., Hamburg, 1996. The encapsulation is a well known process to a person skilled in the art, and may be performed, for instance, using techniques such as spray-drying, agglomeration or yet extrusion; or consists of a coating encapsulation, including coacervation and complex coacervation techniques.

By "perfumery base" we mean here a composition comprising at least one perfuming co-ingredient.

Said perfuming co-ingredient is not of the formula (I). Moreover, by "perfuming co-ingredient" it is meant here a compound which is used in perfuming preparation or composition to impart a hedonic effect. In other words such a co-ingredient, to be considered as being a perfuming one, must be recognized by a person skilled in the art as being able to impart or modify in a positive or pleasant way the odor of a composition, and not just as having an odor.

The nature and type of the perfuming co-ingredients present in the base do not warrant a more detailed description here, which in any case would not be exhaustive, the skilled person being able to select them on the basis of its general knowledge and according to intended use or application and the desired organoleptic effect. In general terms, these perfuming co-ingredients belong to chemical classes as varied as alcohols, aldehydes, ketones, esters, ethers, acetates, nitriles, terpene hydrocarbons, nitrogenous or sulphurous heterocyclic compounds and essential oils, and said perfuming co-ingredients can be of natural or synthetic origin. Many of these co-ingredients are in any case listed in reference texts such as the book by S. Arctander, Perfume and Flavor Chemicals, 1969, Montclair, N.J., USA, or its more recent versions, or in other works of a similar nature, as well as in the abundant patent literature in the field of perfumery. It is also understood that said co-ingredients may also be compounds known to release in a controlled manner various types of perfuming compounds.

For the compositions which comprise both a perfumery carrier and a perfumery base, other suitable perfumery carrier, than those previously specified, can be also ethanol, water/ethanol mixtures, limonene or other terpenes, isoparaffins such as those known under the trademark Isopar® (origin: Exxon Chemical) or glycol ethers and glycol ether esters such as those known under the trademark Dowanol® (origin: Dow Chemical Company).

By "perfumery adjuvant" we mean here an ingredient capable of imparting additional added benefit such as a color, a particular light resistance, chemical stability, etc. A detailed description of the nature and type of adjuvant commonly used in perfuming bases cannot be exhaustive, but it has to be mentioned that said ingredients are well known to a person skilled in the art.

An invention's composition consisting of at least one compound of formula (I) and at least one perfumery carrier represents a particular embodiment of the invention as well as a perfuming composition comprising at least one compound of formula (I), at least one perfumery carrier, at least one perfumery base, and optionally at least one perfumery adjuvant.

According to a specific embodiment of the invention, perfuming compositions of particular interest are the one comprising 2,6,6-trimethyl-1-cyclohexene-1-acetonitrile and natural patchouli (e.g in similar amounts) or the ones comprising 2,6,6-trimethyl-1-cyclohexene-1-acetonitrile, 2,6,10,10-tetramethyl-1-oxaspirol[4.5]decan-6-ol and 4-tert-butyl-1-cyclohexanol.

In fact the invention's compounds, and in particular 2,6,6-trimethyl-1-cyclohexene-1-acetonitrile, can be used to replace in toto or in part patchouli in the perfuming compositions.

It is useful to mention here that the possibility to have, in the compositions mentioned above, more than one compound of formula (I) is important as it enables the perfumer to prepare accords, perfumes, possessing the odor tonality of various compounds of the invention, creating thus new tools for their work.

Preferably, any mixture resulting directly from a chemical synthesis, e.g. without an adequate purification, in which the compound of the invention would be involved as a starting, intermediate or end-product could not be considered as a perfuming composition according to the invention.

Furthermore, the invention's compound can also be advantageously used in all the fields of modern perfumery to positively impart or modify the odor of a consumer product into which said compound (I) is added. Consequently, a perfumed article comprising:

i) as perfuming ingredient, at least one compound of formula (I), as defined above, or an invention's perfuming composition; and ii) a consumer product base;

is also an object of the present invention.

For the sake of clarity, it has to be mentioned that, by "consumer product base", we mean here a consumer product, which is compatible with perfuming ingredients. In other words, a perfumed article according to the invention comprises the functional formulation, as well as optionally additional benefit agents, corresponding to a consumer product, e.g. a detergent or an air freshener, and an olfactive effective amount of at least one invention's compound.

The nature and type of the constituents of the consumer product do not warrant a more detailed description here, which in any case would not be exhaustive, the skilled person being able to select them on the basis of its general knowledge and according to the nature and the desired effect of said product.

Examples of suitable consumer product bases include solid or liquid detergents and fabric softeners as well as all the other articles common in perfumery, namely perfumes, colognes or after-shave lotions, perfumed soaps, shower or bath salts, mousses, oils or gels, hygiene products or hair care products such as shampoos, body-care products, deodorants or antiperspirants, air fresheners and also cosmetic preparations. As detergents there are intended applications such as detergent compositions or cleaning products for washing up or for cleaning various surfaces, e.g. intended for textile, dish or hard-surface treatment, whether they are intended for domestic or industrial use. Other perfumed articles are fabric refreshers, ironing waters, papers, wipes or bleaches.

Some of the above-mentioned consumer product bases may represent an aggressive medium for the invention's compound, so that it may be necessary to protect the latter from premature decomposition, for example by encapsulation.

The proportions in which the compounds according to the invention can be incorporated into the various aforementioned articles or compositions vary within a wide range of values. These values are dependent on the nature of the article to be perfumed and on the desired organoleptic effect as well as the nature of the co-ingredients in a given base when the compounds according to the invention are mixed with perfuming co-ingredients, solvents or additives commonly used in the art.

For example, in the case of perfuming compositions, typical concentrations are in the order of 0.1% to 40% by weight, or even more, of the compounds of the invention based on the weight of the composition into which they are incorporated. Concentrations lower than these, such as in the order of 1% to 25% by weight, can be used when these compounds are incorporated into perfumed articles, percentage being relative to the weight of the article.

EXAMPLES

The invention will now be described in further detail by way of the following examples, wherein the abbreviations have the usual meaning in the art, the temperatures are indicated in degrees centigrade (° C.); the NMR spectral data were recorded in $CDCl_3$ (if not stated otherwise) with a 360 or 400 MHz machine for $^1H$ and $^{13}C$, the chemical displacements δ are indicated in ppm with respect to TMS as standard, the coupling constants J are expressed in Hz. The IR data are given in $cm^{-1}$ and are recorded with the Perkin-Elmer 1600 FT-IR spectrometer.

Example 1

Preparation of a Perfuming Composition

A perfuming composition of the patchouli type was prepared by admixing the following ingredients:

| Ingredient | Parts by weight |
|---|---|
| Absinthe | 5 |
| Fenchylic alcohol | 5 |
| Camphor | 40 |
| Cedar essential oil | 150 |
| Eugenol | 5 |
| Gaiac | 80 |
| 1%* Galbanum essential oil | 20 |
| 10%* Perhydro-4α,8aβ-dimethyl-4a-naphthalenol | 10 |
| Gurjun Baume | 100 |
| 10%* Isobutylquinoleine | 10 |
| 2-Tert-butyl-1,4-dimerhoxybenzene | 80 |
| 10%* Octalactone | 25 |
| Ethyl oenanthate | 5 |
| 2,6,10,10-Tetramethyl-1-oxaspirol[4.5]decan-6-ol | 200 |
| 4-Tert-buty-l-1-cyclohexanol | 110 |
| Ionone | 5 |
| | 850 |

*in dipropyleneglycol

The addition of 150 parts by weight of 2,6,6-trimethyl-1-cyclohexene-1-acetonitrile to the above-described composition resulted in a synergistic effect between the 2,6,10,10-tetramethyl-1-oxaspirol[4.5]decan-6-ol, the 4-tert-butyl-1-cyclohexanol and the invention's compound, which allowed to impart a patchouli character astonishingly close to the one that could have been imparted by the natural patchouli.

Example 2

Preparation of a Perfuming Composition

A cologne for man was prepared by admixing the following ingredients:

| Ingredient | Parts by weight |
|---|---|
| Bergamote essential oil | 330 |
| Citral | 20 |

-continued

| Ingredient | Parts by weight |
|---|---|
| Lemon essential oil | 50 |
| Citronellol | 80 |
| 50%* Civette | 30 |
| 4-Cyclohexyl-2-methyl-2-butanol | 50 |
| Geranium essential oil | 30 |
| Coumarine | 80 |
| 2-Methyl-4-(2,2,3-trimethyl-3-cyclopenten-1-yl)-4-penten-1-ol | 50 |
| Lavandin | 180 |
| Lyral ®[1)] | 300 |
| Mandarine essential oil | 60 |
| Mousse Chêne absolute | 20 |
| Hedione ®[2)] | 700 |
| Sclareolate ®[3)] | 350 |
| Vanilline | 20 |
| Vertofix ® cœur[4)] | 450 |
| | 2800 |

*in dipropyleneglycol

[1)]4/3-(4-Hydroxy-4-methylpentyl)-3-cyclohexene-1-carbaldehyde; origin: International Flavors & Fragrances, USA

[2)]Methyl dihydrojasmonate; origin: Firmenich SA, Geneva, Switzerland

[3)]Propyl (S)-2-(1,1-dimethylpropoxy)propanoate; origin: Firmenich SA, Geneva, Switzerland

[4)]Methyl cedryl ketone; origin: International Flavors & Fragrances, USA

The addition of 700 parts by weight of 2,6,6-trimethyl-1-cyclohexene-1-acetonitrile to the above-described composition imparted a wonderful unique connotation due to a marriage of the earthy/patchouli note and of the fruity/damascony note.

When were added 350 parts by weight of 2,6,6-trimethyl-1-cyclohexene-1-acetonitrile and 350 parts by weight of patchouli, it was obtained a similar olfactive effect to the one obtained by the addition of 700 parts by weight of patchouli. However the composition obtained by adding the two perfuming compound had a stronger, more patchouli/tobacco head note than the one obtained by adding only patchouli.

Example 3

Preparation of trans-(2,6,6,trimethyl-3-cyclohexen-1-yl)acetonitrile a) Preparation of trans-2,6,6-trimethyl-3-cyclohexene-1-methanol

To a stirred suspension of $LiAlH_4$ (1.55 g, 41 mmol) in THF (50 ml) at room temperature was added dropwise a solution of methyl trans-2,6,6-trimethyl-3-cyclohexene-1-carboxylate (10.0 g, purity 98%, 54 mmol) in THF (50 ml). After two hours at room temperature, the mixture was diluted with ether (150 ml), acetone (3 ml) was added dropwise, then 1 N aqueous NaOH (8 ml) was added and the mixture was stirred at room temperature during 30 minutes. $Na_2SO_4$ was added, the solids filtered off and the filtrate concentrated. Bulb-to-bulb distillation (oven temperature 160° C./16 mbar) afforded trans-2,6,6-trimethyl-3-cyclohexene-1-methanol as a colourless liquid (8.40 g, purity >99%, yield 99%).

IR (neat): 3351, 1657

$^1H$-NMR: 5.57-5.51 (m, 1H), 5.46 (br d, J=10, 1H), 3.82 (dd, J=11, J=4, 1H), 3.71 (dd, J=11, J=3, 1H), 2.14-2.02 (m, 1H), 1.95 (br d, J=17, 1H), 1.66 (dd, J=17, J=5, 1H), 1.51 (br s, 1H), 1.1 (d, J=7, 3H), 1.05 (s, 3H), 0.89 (s, 3H).

$^{13}C$-NMR: 132.8 (d), 124.3 (d), 62.4 (t), 52.9 (d), 42.1 (t), 32.2 (s), 31.1 (d), 29.7 (q), 21.9 (q), 20.3 (q).

b) Preparation of trans-(2,6,6-trimethyl-3-cyclohexen-1-yl)acetonitrile

A stirred solution of trans-2,6,6-trimethyl-3-cyclohexene-1-methanol (37.3 g, purity 98%, 237 mmol) in $CH_2Cl_2$ (150 ml) and pyridine (150 ml) was cooled to 0° C. and methane sulfonyl chloride (33.2 g, 284 mmol) was added dropwise within 15 minutes. The mixture was stirred to room temperature during 15 hours, poured on ice-water and ether (300 ml) was added; the mixture was stirred to room temperature during 15 minutes, the organic phase was washed with $H_2O$, 10% aqueous HCl, $H_2O$, saturated aqueous $NaHCO_3$, brine, dried ($Na_2SO_4$) and concentrated.

To a stirred solution of this crude material, in DMSO (500 ml), was added at room temperature NaCN (16.9 g, 346 mmol) and the mixture was heated to 60° C. during 48 hours. The cooled mixture was diluted with ether and $H_2O$, the organic phase was washed twice with $H_2O$, washed with brine, dried ($Na_2SO_4$) and concentrated. Distillation (10 cm Widmer column) afforded trans-(2,6,6-trimethyl-3-cyclohexen-1-yl)acetonitrile as an oil (28.2 g, purity 98%, yield 72%), by 57° C./0.3 mbar.

This compound displayed an aldehydic, patchouli (rooty, earthy) odor note.

IR (neat): 2243, 1658

$^1$H NMR: 5.60-5.53 (m, 1H), 5.44 (br d, J=10, 1H), 2.47 (dd, J=17, J=6, 1H), 2.36 (dd, J=17, J=4, 1H), 2.20-2.09 (m, 1H), 1.98 (br d, J=17, 1H), 1.74 (dd, J=17, J=5, 1H), 1.43-1.37 (m, 1H), 1.11 (d, J=10, 3H), 1.04 (s, 3H), 0.92, (s, 3H).

$^{13}$C-NMR: 131.6 (d), 124.6 (d), 120.1 (s), 47.4 (d), 41.4 (t), 33.6 (d), 32.8 (s), 29.4 (q), 20.2 (q), 19.9 (q), 15.9 (t).

Example 4

Preparation of trans-(2,6,6,trimethylcyclohexyl)acetonitrile

To a solution of trans-(2,6,6-trimethyl-3-cyclohexen-1-yl) acetonitrile obtained in Example 3b) (3.0 g, purity 98%, 18 mmol) in AcOEt (30 ml) was added 10% Pd—C and the mixture was shaken under $H_2$ (1 atm) at room temperature during 3 days. The catalyst was filtered off through celite and the filtrate was concentrated. Bulb-to-bulb distillation (oven temp 80° C./0.3 mbar) afforded trans-(2,6,6,trimethylcyclohexyl)acetonitrile (2.88 g, purity 99%, yield 98%).

This compound displayed a patchouli odor with woody, damascone, earthy, and camphoraceous notes.

IR (neat): 2924, 2243.

$^1$H-NMR: 2.47 (dd, J=17, J=7, 1H), 2.30 (dd, J=17, J=4, 1H), 1.77-1.68 (m, 1H), 1.68-1.57 (m, 1H), 1.52-1.43 (m, 2H), 1.43-1.38 (m, 1H), 1.27-1.17 (m, 1H), 1.17-1.09 (m, 1H), 1.05-0.91 (m, 1H), 1.00 (d, J=7, 3H), 0.96 (s, 3H), 0.92 (s, 3H).

$^{13}$C-NMR: 120.2 (s), 49.9 (d), 41.9 (t), 35.9 (t), 34.3 (s), 32.4 (d), 30.9 (q), 21.8 (t), 20.7 (q), 20.1 (q), 16.1 (t).

Example 5

Preparation of trans-(2,5,6,6,tetramethyl-2-cyclohexen-1-yl)acetonitrile

A stirred solution of trans-2,5,6,6-tetramethyl-2-cyclohexene-1-methanol (9.66 g, purity 65%, 37 mmol) in $CH_2Cl_2$ (30 ml) and pyridine (30 ml) was cooled to 0° C. and methane sulfonyl chloride (7.81 g, 66.8 mmol) was added dropwise within 15 minutes. The mixture was stirred to room temperature during 2 hours, then poured on ice-water and finally was added ether (120 ml); the mixture was stirred to room temperature during 30 minutes, the organic phase was washed with $H_2O$, 10% aqueous HCl, $H_2O$, saturated aqueous $NaHCO_3$, brine, dried ($Na_2SO_4$) and concentrated.

This crude material was dissolved in DMSO (120 ml), NaCN (5.2 g, 106 mmol) was added and the mixture heated to 60° C. during 3 days. The mixture at room temperature was poured on ice-water and ether (200 ml), the organic phase was washed with $H_2O$ and brine, dried ($Na_2SO_4$) and concentrated. Bulb-to-bulb distillation (oven temperature 90° C./0.3 mbar) gave the nitrile, which was flash column chromatographed on silica with cyclohexane-ether 9:1 as eluent, followed by bulb-to-bulb distillation, to afford trans-(2,5,6,6-tetramethyl-2-cyclohexen-1-yl)acetonitrile (2.49 g, purity 82%, yield 31%) as an oil.

The compound displayed an odor of the patchouli, woody-cedar and nitrilic type.

IR (neat): 2965, 2877, 2243.

$^1$H-NMR: 5.46 (br s, 1H), 2.50 (dd, J=17, J=7, 1H), 2.38 (dd, J=17, J=4, 1H), 2.10-2.00 (m, 1H), 1.90-1.85 (m, 1H), 1.76 (br s, 3H), 1.01 (s, 3H), 0.85 (d, J=7, 3H), 0.81 (s, 3H).

$^{13}$C-NMR: 132.7 (s), 123.9 (d), 120.3 (s), 48.4 (d), 35.0 (s), 32.1 (t), 31.2 (d), 25.8 (q), 22.8 (q), 21.1 (q), 17.5 (t), 15.1 (q).

The invention claimed is:

1. A method to confer, enhance, improve or modify the odor properties of a perfuming composition or of a perfumed article to impart patchouli type odor notes, which method comprises adding to said composition or article an effective amount of at least a compound of formula (I)

(I)

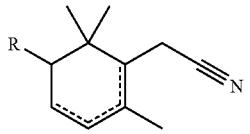

wherein R represents a hydrogen atom or a methyl group, one dotted line represents a carbon-carbon double bond and the other dotted lines represent a carbon-carbon single bond; said compound being in the form of any one of its optical isomers or of a mixture thereof, wherein said compound is added in an amount effective to impart patchouli type odor notes.

2. A method according to claim 1, wherein the compound is added in an amount effective to provide a woody-patchouli character with an earthy note as well as a damascone and tobacco aspect and a quality and intensity such that it is a substitute of natural patchouli.

3. A method according to claim 1, wherein the compound is 2,6,6-trimethyl-1 - cyclohexene-1-acetonitrile.

4. A perfuming composition comprising:

i) as perfuming ingredient, at least one compound of formula (I)

(I)

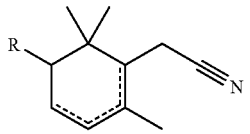

wherein R represents a hydrogen atom or a methyl group, one dotted line represents a carbon-carbon double bond and the other dotted lines represent a carbon-carbon single bond; said compound being in the form of any one of its optical isomers or of a mixture thereof, and wherein said compound is present in an amount effective to impart patchouli type odor notes;

ii) at least one ingredient selected from the group consisting of a perfumery carrier and a perfumery base; and iii) optionally at least one perfumery adjuvant.

5. A perfuming composition according to claim 4, wherein the compound is present in an amount effective to provide a woody-patchouli character with an earthy note as well as a darnascone and tobacco aspect and a quality and intensity such that it is a substitute of natural patchouli.

6. A perfuming composition according to claim 4, comprising 2,6,6-trimethyl -1 -cyclohexene-1-acetonitrile and patchouli or 2,6,10,10-tetramethyl -1 -oxaspirol[4.5]decan-6-ol and 4-tert-butyl-1-cyclohexanol.

7. A perfumed article comprising:

i) as perfuming ingredient, at least one compound of formula (I)

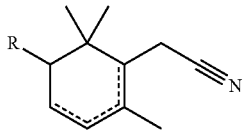

(I)

wherein R represents a hydrogen atom or a methyl group, one dotted line represents a carbon-carbon double bond and the other dotted lines represent a carbon-carbon single bond; said compound being in the form of any one of its optical isomers or of a mixture thereof and wherein compound is present in an amount effective to impart patchouli type odor notes;

ii) a consumer product base.

8. A perfumed article according to claim 7, wherein the consumer product base is a solid or liquid detergent, a fabric softener, a perfume, a cologne or after-shave lotion, a perfumed soap, a shower or bath salt, mousse, oil or gel, a hygiene product, a hair care product, a shampoo, a body-care product, a deodorant or antiperspirant, an air freshener, a cosmetic preparation, a fabric refresher, an ironing water, a paper, a wipe or a bleach.

9. A perfumed article according to claim 7, wherein the compound is present in an amount effective to provide a woody-patchouli character with an earthy note as well as a damascone and tobacco aspect and a quality and intensity such that it is a substitute of natural patchouli.

* * * * *